United States Patent [19]

Dix

[11] 4,056,190

[45] Nov. 1, 1977

[54] PACKAGING ARTICLES AND IDENTIFYING TEMPLATES

[76] Inventor: Walter James Dix, 919 Avondale Ave., Asheboro, N.C. 27203

[21] Appl. No.: 685,992

[22] Filed: May 13, 1976

[51] Int. Cl.[2] ..... B65D 75/36; B65D 75/54; A45C 11/26

[52] U.S. Cl. ..... 206/349; 206/373; 206/461; 206/471; 206/457; 211/60 T

[58] Field of Search ..... 206/461, 462, 471, 459, 206/525, 349, 45.14, 45.19, 44.11, 457, 373; 211/60 T, 60 R, 13

[56] References Cited

U.S. PATENT DOCUMENTS

| | | | |
|---|---|---|---|
| 1,816,598 | 7/1931 | Martin | 206/44.11 |
| 2,936,879 | 5/1960 | Downs | 206/45.19 |
| 3,197,026 | 7/1965 | Gabryel | 206/471 |
| 3,749,233 | 7/1973 | McCormick, Jr. | 206/373 |

FOREIGN PATENT DOCUMENTS

| | | | |
|---|---|---|---|
| 1,562,845 | 3/1969 | France | 211/60 T |

*Primary Examiner*—William T. Dixson, Jr.
*Attorney, Agent, or Firm*—Pennie & Edmonds

[57] ABSTRACT

A template having a silhouette which represents the outline of a consumer-type article such as that of a craftsman and mechanic tool is packaged with the article by means of a backing member and an encasing element received on and supported by the backing member. The encasing element when received on and supported by the backing member thereby substantially immovably confines the article as well as the template therebeneath and forms a package of sturdy construction. The template is a unitary structure capable of removal with the article from the package including means for receiving the same on a supporting surface and serves the use of identification of the location of the article if for any reason the article may have been removed therefrom.

2 Claims, 3 Drawing Figures

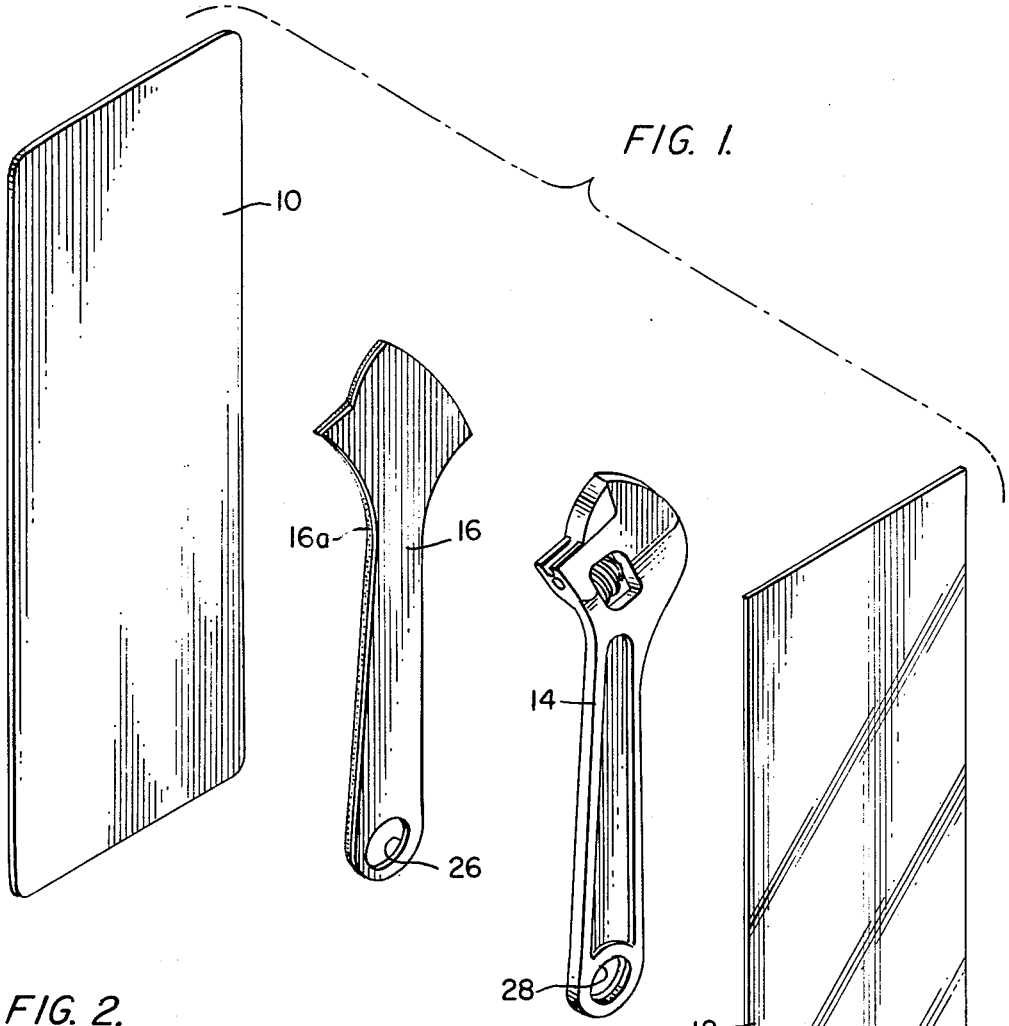
FIG. 1.
FIG. 2.
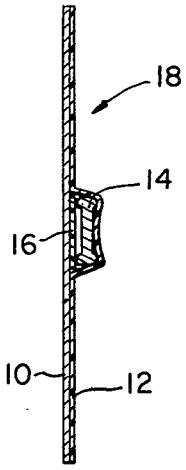
FIG. 3.
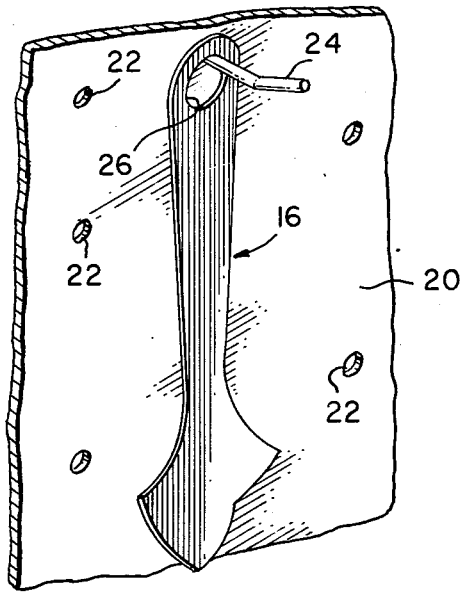

PACKAGING ARTICLES AND IDENTIFYING TEMPLATES

BACKGROUND OF THE INVENTION

The present invention relates to a template having a silhouette representing the outline of a consumer-type article packaged with and removed from the package with the article. The template serves the unique function thereafter of providing location identification of the article on a supporting surface.

One form of packaging for articles such as craftsman and mechanic tools, writing instruments and others comprising a list too long for description herein includes means whereby the article while packaged is exposed to view. This form of package may be comprised of a backing member and an encasing element supported by and secured to the backing member. The encasing element may be of transparent plastic in the form either of a pre-form including a cavity having an outline substantially conforming to that of the article to be received therein and a flange surrounding the opening to the cavity or a sheet of plastic material. The backing member likewise may be of a sheet material such as paperboard and as the encasing element will display suitable strength and thickness charactristics to provide a sturdy housing for the article secured therebetween. In either process operation the encasing element is adhered to the backing member to secure the article therebetween as by heat sealing or by any other well known and accepted sealing technique. In the latter process operation the encasing element may be subjected to pressure thereby to conform it to the outline and contour of the article. In both process operations the article substantially is immobilized between the backing member and encasing element.

Many articles such as craftsman and mechanic tools include within a handle portion or elsewhere an opening or some other structural means which facilitates mounting the article on a supporting surface, for example, by receiving it on a hanger of the type adapted for cooperation with one or more openings in a section of pegboard. Oftentimes the owner of the article will so mount it and on occasion has proceeded to reproduce an outline or replica of the article on the supporting surface so that placement of the article relative to other articles similarly received may be appreciated when the article removed from the supporting surface for any reason is returned. Moreover, by the reproduction of the outline or replica of the article on the supporting surface the owner always will be apprised as to those articles which are owned and which are not present.

A representative prior art teaching wherein a replica of an article, illustrated as being a lock or a key, is provided on a supporting surface is Jackson U.S. Pat. No. 791,912. In Jackson the supporting surface is a card useful to a salesman in the showing of his wares when the actual item may have been removed.

The technique discussed above and as illustrated and described by Jackson suffers from the disadvantage, among others, that a degree of artistic ability not possessed by all individuals is required in the reproduction of either an outline or a replica on a supporting surface to locate the particular article. While not impossible, because of this inability it is likely that the outline or replica of the article will not be provided on the supporting surface which, therefore, will be without identification. Thus, the owner will neither be apprised of missing articles nor will he be able always to return the article to its proper location.

BRIEF DESCRIPTION OF THE INVENTION

The present invention seeks to overcome this problem by the marketing with the article of a template having an outline or being in the form of a replica of that article and which may be mounted either in "permanent" fashion or otherwise on a supporting surface thereby to provide identification of the location of the article received thereover. Thus, the invention is directed to the combination with a packaged article of a template having an outline representing the outline or silhouette of the article and removable from the package with the article and to a template adapted to be so packaged and useful in the identification of the location to which the article is to be returned to the supporting surface after use.

Other advantages of the present invention will become clear to those skilled in the art during a reading of the following portion of the specification and upon a consideration of the drawing which forms a part of this application.

BRIEF DESCRIPTION OF THE DRAWING

FIG. 1 is an exploded perspective of the components forming the package as well as an article and template received therein;

FIG. 2 is a horizontal section through the package; and,

FIG. 3 is a perspective view of the template illustrated in a position supported by a hanger carried, in turn, by a supporting member.

DESCRIPTION OF THE PREFERRED EMBODIMENT

The template of the present invention while having many suitable applications will be described herein in terms of being packaged with a tool and its unique function later (after purchase of the tool) of identifying the supported location of the tool on a supporting surface to facilitate a return of the tool to its proper place if removed for any purpose.

The template may be enclosed by any form of package, such as the package generally described above which may have been recognized as being of conventional form in the prior art. Thus, the components include a backing member 10 and an encasing element 12, both illustrated in FIG. 1 as being of sheet form.

While many common mediums have been resorted to, conventionally, the backing member is of paperboard having an adequate ply to provide a sturdy card backing. Typical of the other mediums are plastics, metals and foils capable of adherence or affixation of the encasing element thereto. The encasing element preferably is of thermoplastic plastic sheet material. Various thermoplastic plastics capable of being rolled or otherwise provided in sheet form and having a softening point thereby to undergo conventional forming and sealing techniques, those displaying a good degree of transparency and those of sufficient strength to withstand rupture or tearing, such as polyvinylchloride or one of the polyolefins may be used. Polyvinylchloride has been used satisfactorily and is preferred.

In accordance with the present invention, both a tool, such as the crescent wrench 14, and a template 16 having a silhouette representing the outline of the cresent wrench are supported within the package, identified by the numeral 18 (see FIG. 2). The package of FIG. 2 suggests a processing technique whereby the encasing element in sheet form is moved relative to the backing member and then sealed to the exposed surface of the backing member adjacent to the crescent wrench. At the same time the encasing element under influence of pressure will be moved to position juxtaposed to the outline and contour of the crescent wrench.

As discussed above, the encasing element may be a pre-form (not shown) including a cavity of the outline of the crescent wrench and surrounding flange. The flange is sealed to the backing member by any known processing technique.

The template 16 shaped to the silhouette of the crescent wrench, or any other form as determined by the tool with which it is packaged comprises an important aspect of the present invention.

The template may be formed of various materials for affixation to a support surface. The invention contemplates that the template may be "permanently" affixed or else affixed in a manner whereby the template as the crescent wrench may be relocated to a different location if a different arrangement of tools is desired. Thus, if the template is to be "permanently" affixed it may take the form of a decal, a thin sheet of paperboard, or else be of a relatively thin plastic, metal or other suitable material having an adhesive or pressure sensitive backing 16*a* with an overlying cover layer removable for affixing use as known in the prior art. Typical of such construction are stickers of the type used in county vehicle identification. If the template is to be capable of relocation it preferably will be formed of paperboard, plastic, metal or any other suitable material, all which display sufficient strength and rigidity characteristics to maintain a planar integrity and proper outline. Further, it will display sufficient weight thereby to hang juxtaposed to the supporting surface yet not to unduly increase the weight of the package, be relatively inexpensive and readily formable as by die cutting to the outline of the crescent wrench or other tool with which it is marketed. Paperboard having a ply of, for example, from between one to four points (about 0.015 inch to about 0.06 inch) has been found to provide these characteristics for the latter adaptation and a paperboard of about two points thickness has been used successfully. In the former adaptation the template in decal form has been used successfully. In either case, the template will be of an opaque material or one which will receive an opaque surface coat so that it clearly may be seen on the supporting surface.

The template provides the unique function of locating the crescent wrench or other tool on a supporting surface such as the paperboard 20, a portion of a section being illustrated in FIG. 3. As well known, the pegboard provides a pattern of apertures 22, only a few of which are shown for the sake of simplification, with each one or group of apertures adapted to receive the mounting portion (not shown) of a hanger 24. The template provides an opening 26 through which the hanger may be passed. The crescent wrench 14 likewise provides an opening 28 for the same purpose, thereby to be received on the hanger 24 in position over the template 16. Thus, the crescent wrench may be removed and relocated to the same position, a position which is defined by template 14. For greater aesthetic appeal the template may include on one face a photoreproduction of the actual tool or article with which it is associated.

As may be apparent, the illustrations represent a tool having an aperture in the handle. If, for example, the tool to be mounted was a hammer, it is apparent that the hanger would be of a different form to receive the working portions of the hammer thereover. The template would comprise a silhouette of the hammer and be received on the hanger in a similar manner or else "permanently" on the supporting surface.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

Having described the invention, what is claimed is:

1. A package for an article comprising a backing member having a mounting surface and an encasing element, said encasing element when received on and adhered to said backing member conforming substantially to the outline of said article thereby to support said article adjacent said backing member, and wherein the improvement comprises a template, said template formed by a sheet material body having a silhouette forming a representation of the outline of said article, said template body including means by which it may be supportingly received on a display surface to identify the placement of said article, and said template body being received in said package juxtaposed said mounting surface of said backing member and below said article and encasing element.

2. The combination of claim 1 wherein one surface of said body carries adhesive means to affix said template on said surface.

* * * * *